US005335904A

United States Patent [19]

Ryuzaki

[11] Patent Number: 5,335,904

[45] Date of Patent: Aug. 9, 1994

[54] SHEET TRANSPORT ROLLER DEVICE

[75] Inventor: Takahiko Ryuzaki, Kanagawa, Japan

[73] Assignee: Fuji Xerox Co., Ltd., Tokyo, Japan

[21] Appl. No.: 47,839

[22] Filed: Apr. 19, 1993

[30] Foreign Application Priority Data

Apr. 20, 1992 [JP] Japan ..... 4-126751

[51] Int. Cl.[5] ..... B65H 5/00

[52] U.S. Cl. ..... 271/272; 271/236; 271/250

[58] Field of Search ..... 271/272, 273, 274, 236, 271/245, 246, 247, 252, 250; 198/781, 806; 100/176; 226/181, 187

[56] References Cited

U.S. PATENT DOCUMENTS 4,685,664 8/1987 Petersdorf ..... 271/236

5,181,715 1/1993 Ohkoda et al. ..... 271/273

5,219,159 6/1993 Malachowski et al. ..... 271/252

*Primary Examiner*—H. Grant Skaggs

*Attorney, Agent, or Firm*—Finnegan, Henderson, Farabow, Garrett & Dunner

[57] ABSTRACT

A sheet transport roller device is disclosed, comprising a drive roller member and a free roller member disposed facing each other with a specified pressure between them and transport a sheet held between them, a device which allows each roller of the drive and free roller members to move in the axial direction, urging members disposed at both ends of the rollers, in which the roller devices are moved in the direction lateral to a sheet transport path as a sheet is being held by the roller devices, in accordance with an action moving said sheet in the direction lateral to the transport path.

7 Claims, 9 Drawing Sheets

SHEET TRANSPORT ROLLER DEVICE

FIELD OF THE INVENTION

The present invention relates to a registration device in the recording medium transport path of an image-forming device such as an electronic copier, and more particularly to a transport roller device which after aligning a sheet of the recording medium laterally, moves a transport roller laterally by an appropriate amount depending on shear stress applied to the sheet, and the lateral reaction force of the sheet, to eliminate the stress applied to the sheet.

BACKGROUND OF THE INVENTION

An image-forming device using an electrophotographic system such as a copying machine or a laser printer transfers a toner image formed on a photoreceptive drum to a sheet of recording medium, passes the sheet with the toner image thereon through a fuser and feeds out a result. In such an image-forming device, a sheet supplied from the feeding portion provided with a feed tray is transported to an image transfer section by a transport roller device provided in the sheet transport path, and positioning of the leading edge of the sheet is carried out by a sheet registration system disposed immediately before the image transfer section. A sheet is fed in synchronism with the formation of the toner image on the photoreceptive drum and the toner image is transferred.

In an image-forming device of a general copying machine, a sheet supplied from a feed tray is transported being held by a transport roller device disposed in the sheet transport path. The transport roller device in the sheet transport path may, however, have inaccuracies in the positioning of their axes, or the rollers of rubber or the like may not be precisely circular, or the pressure of the transport roller device may not be even in the lateral direction of the transport path. Further, in transporting a sheet held by the rollers, skewing of the sheet may occur.

To prevent this, a sheet registration system is disposed immediately before the image transfer section, and in the image transfer section, the sheet is brought in registration with a reference line. The sheet registration system comprises a combination of registration roller device and gate members disposed immediately before the photosensitive drum and a preregistration roller device disposed upstream of the registration roller device with a specified spacing. The leading edge of a sheet transported in the sheet transport path is stopped by the gate members and the sheet is curved by additional feeding of the preregistration roller device. The curve of the sheet presses the leading edge of the sheet against the gate members uniformly and thus registration of the leading edge of the sheet is carried out so as to prevent skewing of the sheet transported by the registration system toward the image transfer section.

To register a sheet in the image transfer section, Japanese unexamined patent publication Hei 3-94275 (1991) describes the provision of a sheet registration system. A sheet registration system shown in the conventional examples has, as shown in FIG. 19, a sheet registration system 10 comprising a registration roller device 11 and a preregistration roller device 12, and gate members 3 selectively appearing in the sheet transport path are disposed immediately before the registration roller device 11. The registration roller device 11 comprises a drive axis 11*a* having a plurality of rollers 11*b* installed thereon, and a driven gear 18 and a lateral movement mechanism 15 both disposed at an end of the drive axis 11*a*.

The lateral movement mechanism 15 comprising a driven gear member 16 disposed around an end of the drive axis and a drive gear 17 provided on the body of the unit allows the drive axis to move reciprocally in the direction of the arrow y. The driven gear 16 allows the drive axis to rotate freely but constrains it to move axially. A sheet detector Sr is disposed at the other end of the drive axis, and it controls the movement in the lateral direction of the drive axis, in registering a sheet, by moving registration roller device 11 laterally as the leading edge of the sheet is held. The preregistration roller device 12 disposed upstream of the registration roller device 11 comprises a drive axis 12*a* having a plurality of rollers 12*b* installed thereon.

In the sheet registration system 10 shown in FIG. 19, if a sheet is transported skewed or off the reference line K, the sheet detector Sp detects it and makes the registration roller device 11 move in the direction lateral to the sheet transport path, corresponding to the detection. For example, if a sheet is transported off the reference line K as shown in the figure, the leading edge Pa of the sheet is stopped by the gate members 3, and the sheet is curved by the additional feeding of the preregistration roller device 12. Registration of the sheet is carried out by releasing the gate members 3, causing the leading edge of the sheet to be held by the registration roller device 11, stopping the leading edge of the sheet at the position shown as Pb in the figure and moving the registration roller device 11 in the direction lateral to the sheet transport path by means of the lateral movement mechanism 15 to the position where the side of the sheet is detected by the sheet detector Sp.

After being thus registered, the sheet is fed out from the registration system with a feed-out time matched with the formation of a toner image on the photoreceptive drum. Thus, positioning of the sheet fed from the sheet registration system is carried out by making its side brought in registration with the reference line K, which prevent dislocation of the toner image transferred to the sheet.

As described so far, in the registration system comprising a registration roller device movable along its axis and a preregistration roller device disposed at a specified position, a sheet moved in the direction lateral to the transport path by the registration roller device is subject to a shear stress between the registration roller device and the preregistration roller device which holds the sheet at the specified position. The further the sheet is moved in the lateral direction of the path by the registration roller device, the more shear stress is applied, and this may lead to wrinkling of sheet.

After being released from the preregistration roller device, the sheet is fed only by the registration roller device, and this may cause incomplete location of a transferred toner image, because the lateral reaction force of the sheet varies and the sheet is moved in the direction lateral to the transport path.

To prevent this, for example, the provision of a means which allows the preregistration roller device 12 to move in the direction lateral to the sheet transport path as shown in FIG. 20 has been proposed. When the sheet is moved in the direction lateral to the path, the springs 13 and 13*a* disposed at both ends of the preregistration roller device expand or contract with the shear reaction force of the sheet, thus eliminating the shear reaction force in the sheet. Whenever registration of a sheet is carried out, the springs 13 and 13*a* expand and contract, and the repetition deteriorates the spring, so that the preregistration roller device fails to return to its correct position after repeated use.

The sheet registration system shown in FIG. 19 is disposed corresponding to the image transfer section. In a color copying machine, in disposing a sheet registration system in the place supplying a sheet to the transfer drum, the sheet is subject to a shear stress. For example, Japanese unexamined patent publication Hei 2-238480 (1990) describes a color copying machine in which a photoreceptive drum is disposed facing a transfer drum holding a sheet, the photoreceptive drum has a plurality of color developers and color images formed on the photoreceptive drum are transferred in sequence and superimposed on the sheet held by the transfer drum.

To supply a sheet to the transfer drum, a sheet registration system as shown in FIG. 21 is provided. The sheet registration system comprises a registration roller device 11 and a preregistration roller device 12 similar to those shown in FIG. 19, and it makes the sheet P curve and registers the leading edge of the sheet and then supplies it to the transfer drum. In the example shown in FIG. 21, however, in registering and feeding out a sheet, a shear stress in the direction shown by an arrow F may be applied to the sheet P.

Being fed out by the two rollers devices, the sheet is pressed against the transfer drum 5 off the reference line K, which may distort the film provided as a sheet retaining member on the transfer drum. When the trailing edge of the sheet is released from the preregistration roller device, the film distorting force of the sheet is released, and the reaction force of the film dislocates the sheet in the direction of the reference line K. In a color copying machine, if transfer of the first color toner image is started while the sheet is being fed to the transfer drum, the sheet may move in the lateral direction while transferring the toner image of the first color, which leads to deterioration of the image quality.

SUMMARY OF THE INVENTION

It is an object of the present invention to provide a sheet registration system free of the defects found in the conventional art.

It is another object of the present invention to provide a sheet registration system in which the roller device is moved in the lateral direction of the sheet by a shear reaction force of the sheet, in registering a sheet.

It is a further object of the present invention to provide a sheet registration system comprising a device which prevents a sheet fed out from the sheet registration system from moving in the lateral direction of the sheet while being fed.

Additional objects and advantages of the invention will be set forth in part in the description which follows and in part will be apparent to a person with ordinary skill in the art from the description, or may be learned by practice of the invention.

BRIEF DESCRIPTION OF THE DRAWING

The manner by which the above objects and other objects, features and advantages of the present invention are attained will be fully evident from the following detailed description when it is considered in light of the accompanying drawings, wherein.

DETAILED DESCRIPTION OF THE INVENTION

Figure 1:
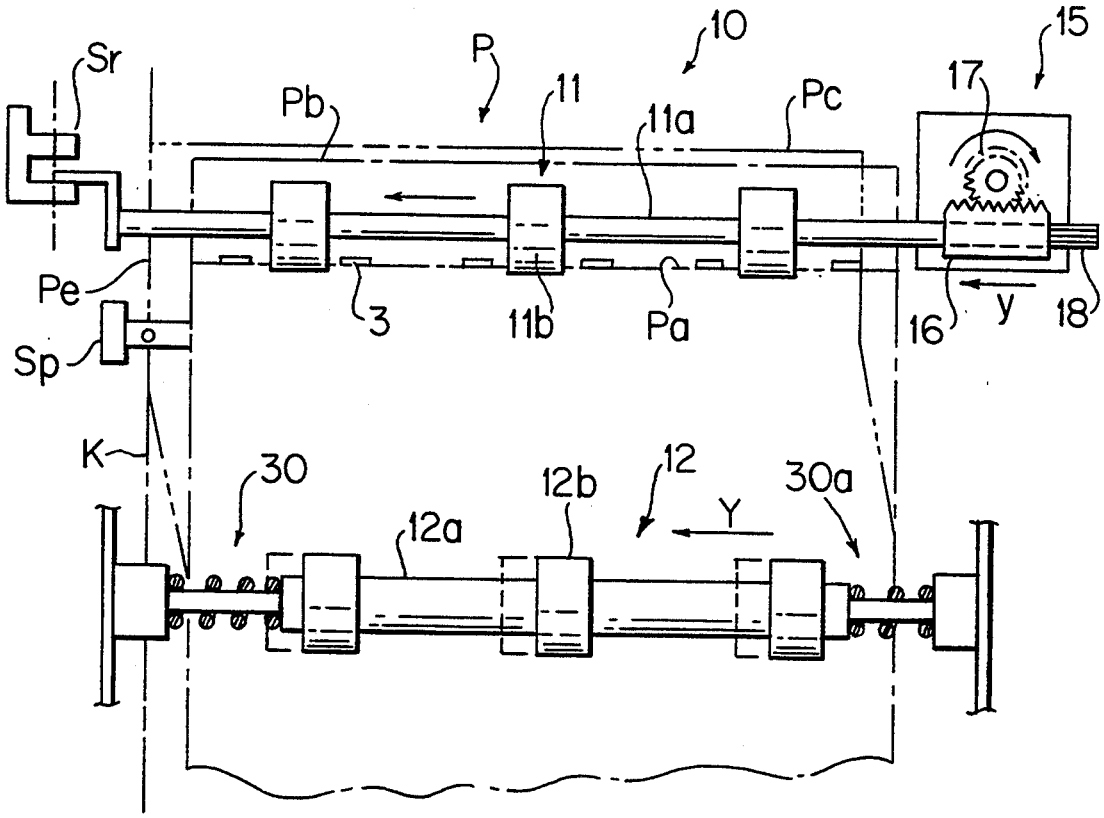
FIG. 1 illustrates the structure of the sheet registration system of the present invention.

The present invention relates to a transport roller device comprising pairs of a drive roller member and a free roller member disposed facing each other with a specified pressure between them and which feed out a sheet while holding it, allowing each of the drive and the free roller members to move simultaneously in the direction along the drive axis, and having urging members at both ends of the rollers. The sheet transport roller device can be moved in the direction lateral to the sheet transport path while holding a sheet.

In the transport roller device of the present invention comprising pairs of a drive roller member and a free roller member, lateral movement control mechanisms having springs therein are disposed at both ends of the rollers. A mechanism therein controls expansion but allows contraction of a spring, if the other spring moves. The force moving the rollers being released, the lateral movement control mechanisms disposed at both ends of the rollers return the rollers automatically to their original position.

Further, in the present invention, each roller of the drive roller member and the free roller member forming the transport roller device is fixed to the drive axis which is movable in the axial direction by means of linear bearing members disposed in the main frame, lateral movement control mechanisms whose stoppers allow the spring to receive only the compression force and control the expansion of the spring are disposed respectively between the bearing members of the main frame and the roller. After the force moving the rollers caused by a sheet is released, the rollers of the drive roller member and the free roller member return to their original position by the lateral movement control mechanisms disposed at both ends of the rollers.

In addition to the above described structure, each of the drive roller member and the free roller member forming the transport roller device of the present invention comprises rollers fixed to the drive axis which is movable in the axial direction by means of linear bearing members, spring retainers disposed at both ends of the roller, a means which controls the length of the movement in the axial direction of the spring retainers and lateral movement control mechanisms disposed at both ends of the rollers respectively between the spring retainer and the bearing member installed in the main frame, which return the rollers to their original position, after a force moving the rollers caused by a sheet is released.

A device having the above described construction can be applied to a sheet registration system which has a registration roller device, a preregistration roller device and gate members in the sheet transport path, moves the registration roller device in the lateral direction of the transport path as the leading edge of the sheet is held by a registration roller device, and feeds out the sheet along the reference line. In such a case, in addition to providing a device which allows each roller of the drive and free roller members forming the preregistration roller device to move in the axial direction, lateral movement control mechanisms are disposed at both ends of the rollers and allow the rollers forming the preregistration roller device to be moved in the axial direction while holding a sheet by lateral stresses applied to a sheet, which is caused by an action of the registration roller device to move a sheet in the lateral direction of a sheet transport path. After feeding out a sheet, the lateral movement control mechanisms return the rollers to their original position, automatically.

The roller device of the present invention can also be applied to a sheet registration system which transfers color toner images successively by a color toner image transfer apparatus disposed corresponding to a transfer drum holding a sheet. The registration system comprises a registration roller device, a preregistration roller device and gate members in the area where a sheet is supplied to the transfer drum by driving the registration roller device with the sheet brought in registration by the registration and preregistration roller devices. In the roller device of the present invention, in addition to the device which allows each roller of the drive and free roller members forming the registration roller device to move in the axial direction, the lateral movement control mechanisms are disposed at both ends of the rollers, which eliminate a reaction force by moving the rollers laterally as a sheet is held by rollers forming the registration roller device by a reaction force from shear strain occurring in the sheet, and after feeding out a sheet, return the rollers to their original position, automatically.

Besides the above described embodiment, the present invention can also be applied to a sheet registration system disposed upstream of the toner image transfer section of the image-forming device, comprising a registration roller device and a preregistration roller device and which supplies a sheet to the image transfer section by driving the registration roller device with the sheet brought in registration between the registration roller device and the preregistration roller device.

In the image-forming device, can be disposed a device which allows each roller of the drive and free roller members forming the registration roller device to move in the axial direction and lateral movement control mechanisms provided at both ends of the roller and allowing the rollers forming the registration roller device to be moved in the lateral direction of the path as a sheet is held by the rollers, when registering a sheet, by a reaction force from shear strain occurring in the sheet, to release the reaction force, and after feeding out, returning the rollers automatically to their original position.

Providing a device moving the roller member in the direction eliminating the reaction force of the sheet, when receiving a lateral reaction force of a sheet makes it possible, in registering a sheet, to release a shear stress applied to the sheet. Moving the roller device in the lateral direction of the sheet transport path prevents wrinklings in the sheet from occurring, which leads to a good transport of a sheet. The lateral movement control mechanisms disposed at both ends of the roller of the present invention have devices which allow the springs to contract for a short distance and do not allow their expansion, which leads to a long life of the springs. Therefore, the lateral movement control mechanisms provide an accurate centering function to the roller device and the roller device can guide a sheet to a proper position.

EMBODIMENT

Figure 19:
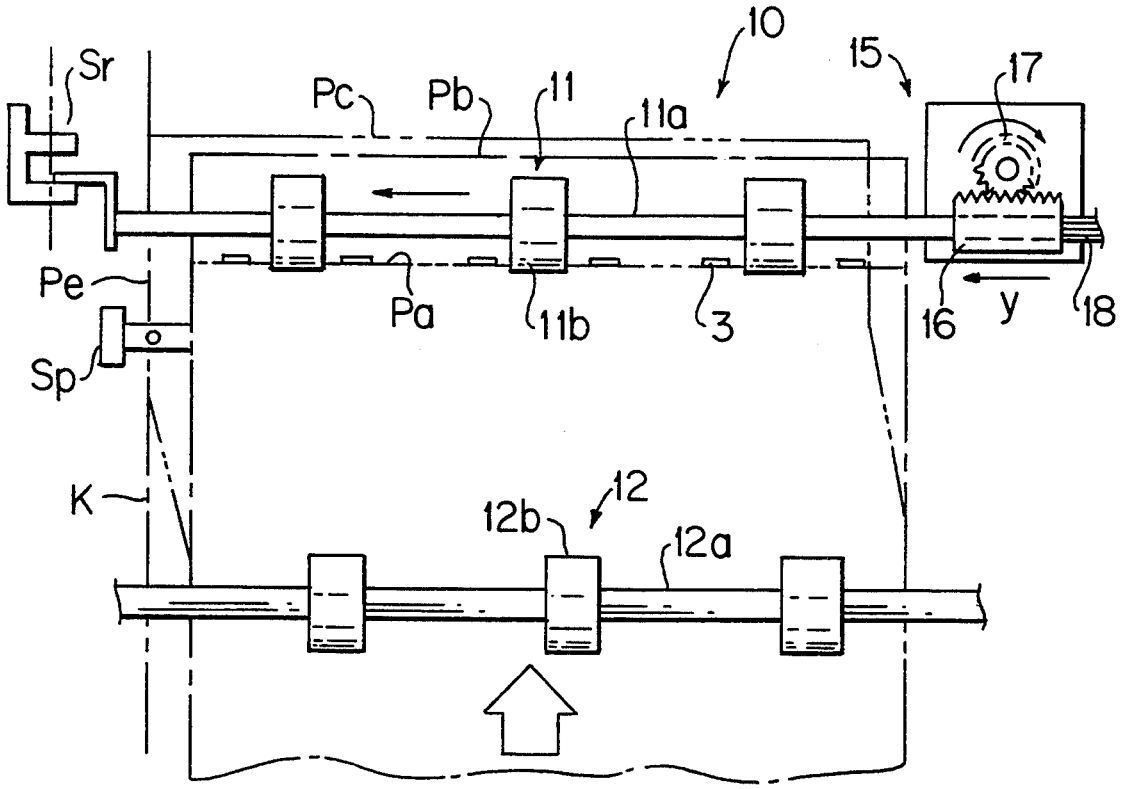
FIG. 19 illustrates the structure of a conventional sheet registration system.
Figure 20:
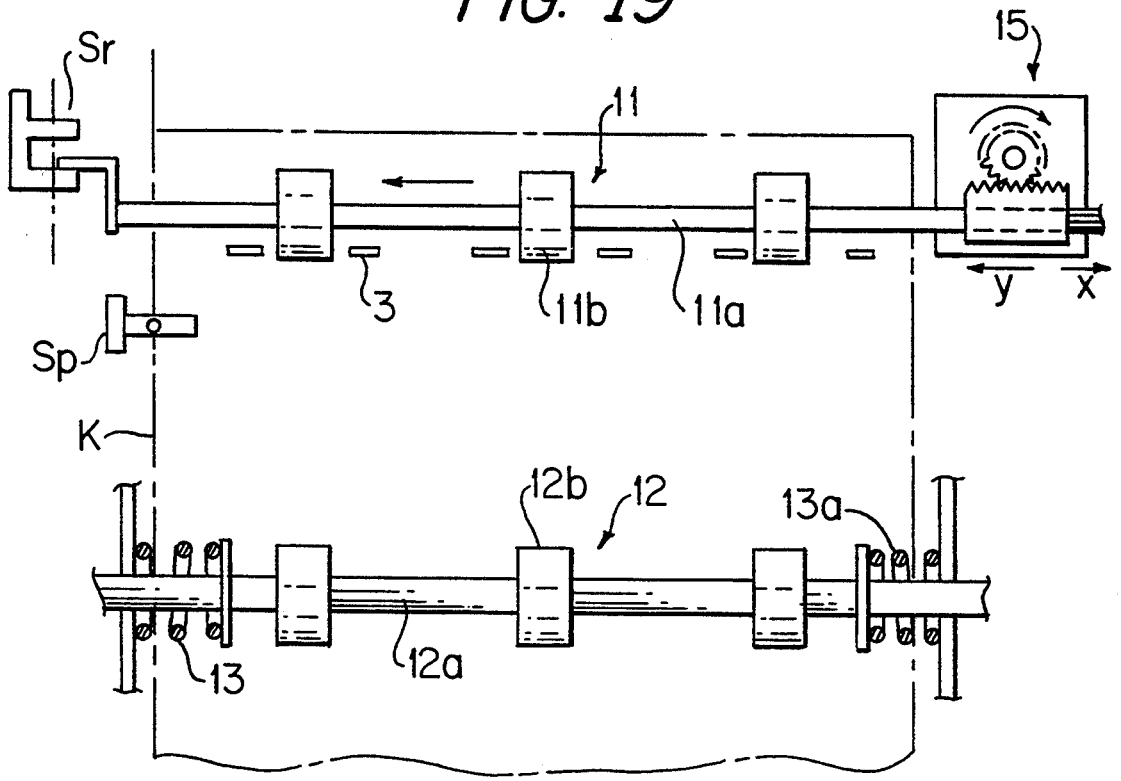
FIG. 20 illustrates another example of a conventional sheet registration system.

A sheet transport roller device of the present invention is now described referring to the Figures. In FIG. 1, as a conventional sheet registration system 10 shown in FIG. 19, a registration roller device 11 and a preregistration roller device 12 with a specified spacing therebetween and gate members 3 provided immediately before the registration roller device 11 and selectively appearing in the sheet transport path are disposed. The registration roller device 11 comprises a drive axis 11*a* having a plurality of rollers 11*b* installed therein, a driven gear 18 and a lateral movement mechanism 15 both disposed at an end of the drive axis 11*a*.

The lateral movement mechanism 15 comprising a driven gear 16 disposed around the drive axis and a drive gear 17 provided on the body of the unit allows the drive axis to move reciprocally in the direction of the arrow y. The driven gear 16 allows the drive axis to rotate freely but constrains it to move axially, so by driving the lateral movement mechanism 15, the registration roller device 11 can be moved in the lateral direction of the sheet transport path.

At the other end of the drive axis is disposed a sheet detector Sr used to control the movement of the drive axis for positioning a sheet, and in registering a sheet, a registration roller device 11 is moved laterally while holding the leading edge of a sheet, and when the side Pe of the sheet is brought in registration with the reference line K, a sheet is fed. After the trailing edge of the sheet pass the registration roller device 11, the sheet detector Sr returns the registration roller device 11 to the specified position.

Figure 2:
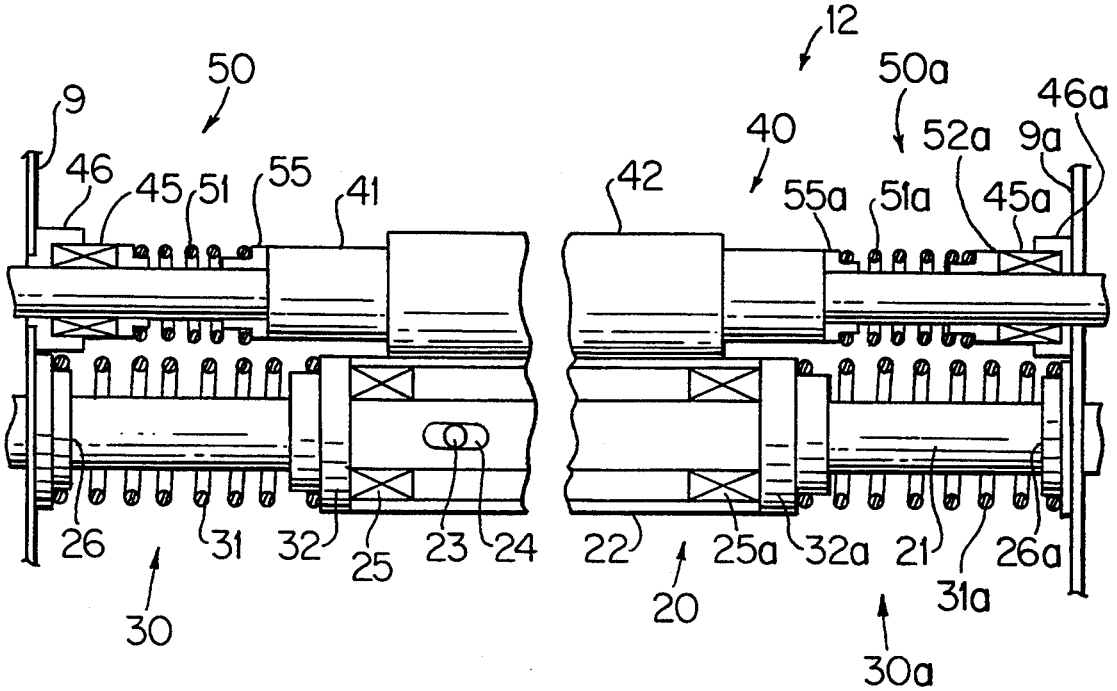
FIG. 2 illustrates the structure of a roller device of the present invention.

The preregistration roller device 12 disposed upstream of the registration roller device 11, as described in detail referring to examples shown in FIG. 2 and onwards, comprises a pair of lateral movement control mechanisms 30 and 30*a* disposed at both ends of the roller. If shear stress is applied to a sheet being held by the registration roller device and the preregistration roller device, its reaction force can be eliminated by moving the preregistration roller device in the lateral direction of the sheet transport path by means of the lateral movement control mechanisms. If the trailing edge of the sheet is released from the preregistration roller device, the reaction force of the sheet is released, and the urging members in the lateral movement control mechanisms, the springs, allow the rollers to return automatically to their original position.

In the sheet registration system 10 shown in the FIG. 1, if a sheet is transported skewed or off the reference line K of the sheet transport path, the sheet detector Sp detects it and makes the registration roller device 11 move laterally. For example, as shown in the Figure, if a sheet is transported off the reference line K, the leading edge of the sheet is stopped by the gate members 3, and by additional feeding of the preregistration roller device 12, the sheet is curved. After releasing the gate members 3, causing the leading edge of the sheet to be held by the registration roller device 11 and stopping the leading edge at the position shown as Pb, the registration roller device 11 is moved in the lateral direction of the path by means of the lateral movement mechanisms 15 until the area where the side of the sheet is detected by the sheet detector Sp, which is followed by sheet registration.

In registering a sheet, as a sheet is moved in the lateral direction of the path with its leading edge held by the registration roller device 11, the sheet is subject to a shear stress between the registration roller device 11 and the preregistration roller device 12. In the sheet registration system of the present invention, the preregistration roller device 12 is moved in the axial direction by a shear reaction force of the sheet which is held by the registration roller device 11 and the preregistration roller device 12, and the sheet is fed to the next process with the transport roller device eliminating the shear stress applied to the sheet.

FIG. 2 shows a device of the present invention which allows the preregistration roller device to move in the direction along the drive axis. The symbols indicating each portion of FIG. 2 are different from those in FIG. 1, and a drive roller member 20 and a free roller member 40 are disposed facing each other with a specified pressure between them, and they feed out a sheet while holding it. The drive roller member 20 is supported by a drive axis 21 connected to a drive system which is not shown in the figures and having a roller 22 thereon with linear bearing members 25 and 25*a* interposed therebetween and allowing the roller 22 to move axially with respect to the drive axis 21. The drive force is conveyed by engaging a drive pin member 23 provided on the drive axis in a slot 24 provided in the roller 22. At both ends of roller 22 are disposed lateral movement control mechanisms 30 and 30*a* which allow, when a reaction forces on the rollers are released, the rollers to return to their original position.

The free roller member 40 disposed facing the drive roller member 20 comprises a roller 42 fixed to the drive axis 41 which is supported by the main frames 9 and 9*a* by means of linear bearing members 45 and 45*a* and allows the drive axis 41 to move in the axial direction with the roller. At both ends of the roller member 42 are disposed lateral movement control mechanisms 50 and 50*a* respectively between the roller and linear bearing members 45 or 45*a*, and after the roller 42 is moved in the axial direction by a reaction force from a sheet, the lateral movement control mechanisms return the roller to its original position.

Figure 3:
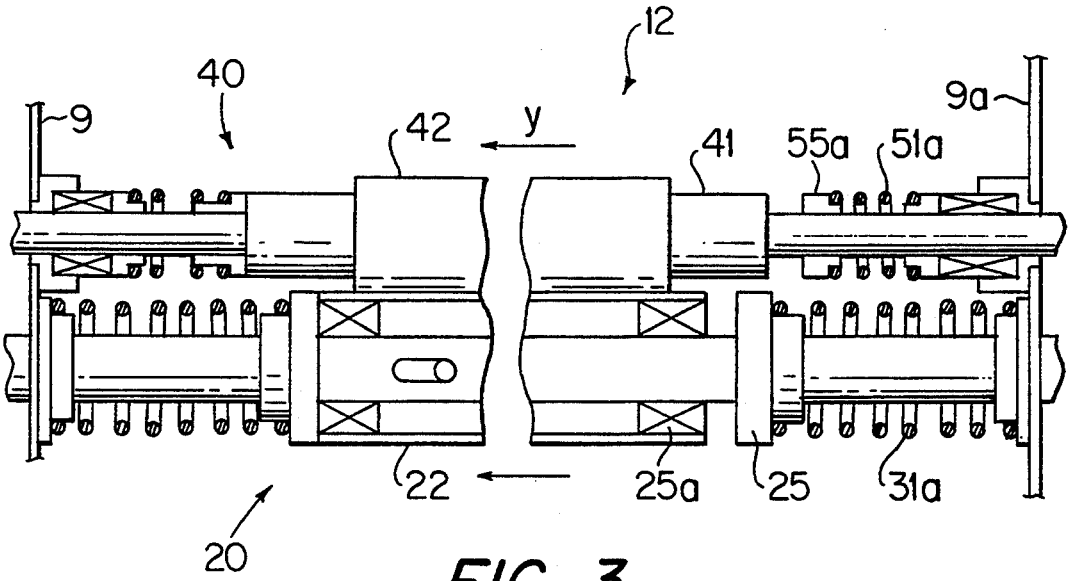
FIG. 3 illustrates the state of a roller device being moved by a sheet.

FIG. 3 illustrates the position of the rollers of the preregistration roller device 12 shown in FIG. 2, as the device is moved in the axial direction by the reaction force from a sheet. If, as shown in FIG. 3, the rollers are moved in the direction of the arrow y by the reaction force from the sheet held between the rollers 22 and 42, the lateral movement control mechanisms 30 and 50 which are under compression contract and the lateral movement control mechanisms 30*a* and 50*a* provided at the other end of the rollers remain as they are, being kept apart from the rollers. The springs provided in the lateral movement control mechanism of the present invention can be compressed but is controlled so as not to expand.

Figure 4:
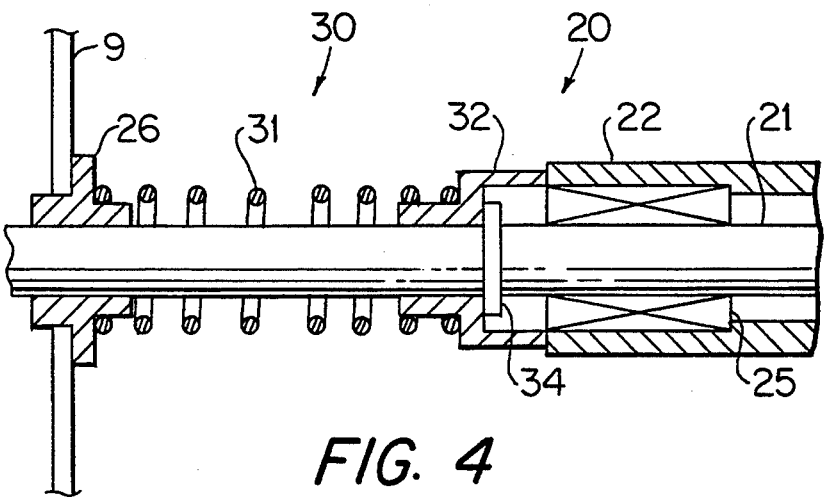
FIG. 4 illustrates the structure of an end of a drive roller member of the present invention.
Figure 5:
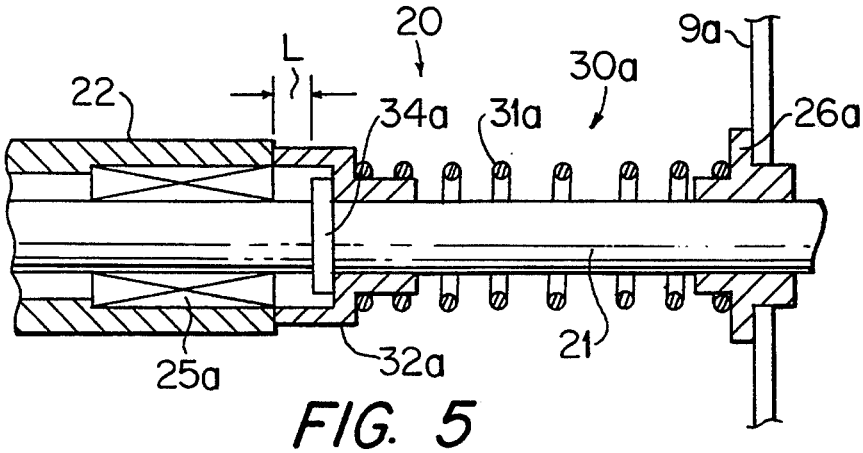
FIG. 5 illustrates the structure of the other end of a drive roller member of the present invention.
Figure 6:
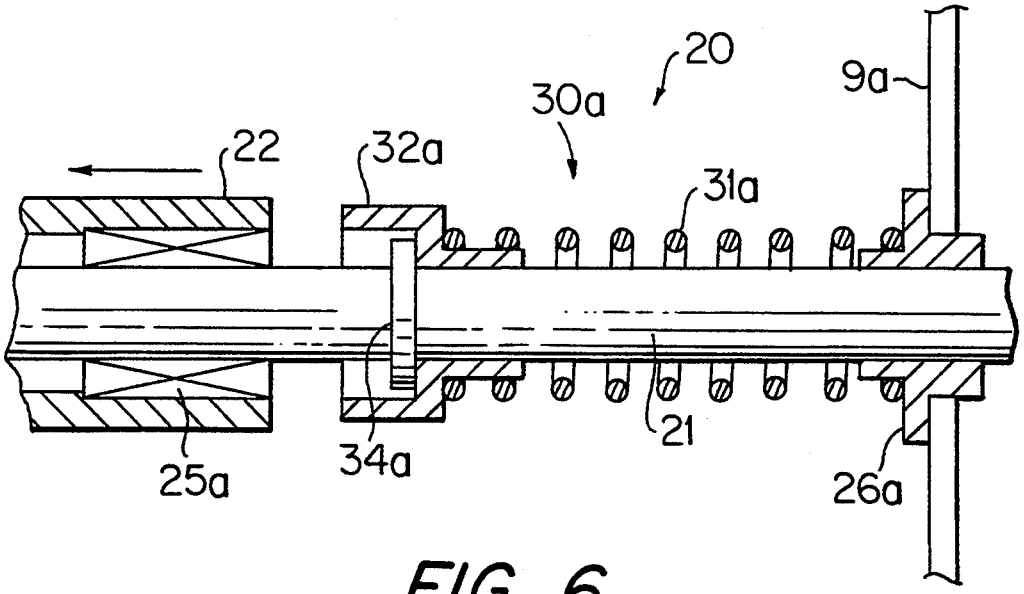
FIG. 6 illustrates the state of a drive roller member being moved.

In order not to allow excessive expansion and contraction to occur in the springs even if the rollers are moved in the axial direction, the drive roller member 20 of the present invention is structured as shown in FIGS. 4 to 6 and the free roller member 40 is structured as shown in FIGS. 7 to 10. The drive roller member 20 of the present invention is now described referring to FIGS. 4 and 5. In an example shown in FIG. 4, a roller 22 is supported by the drive axis 21 of the drive roller member 20 with linear bearing member 25 interposed therebetween which allows the roller 22 to move in the axial direction with respect to the drive axis 21. As shown in FIG. 2, between the drive axis 21 and the roller 22 is provided a drive force conveying means comprising a pin member and a slot, which allows a roller 22 to be moved by the drive axis and to move in the axial direction.

Regarding the drive roller member 20, a bearing 26 supports the drive axis in the main frame 9, and the lateral movement control mechanism 30 comprises a spring retainer 32 disposed at an end of the roller 22 and a spring 31 provided between the bearing 26 and the spring retainer 32. In addition to maintaining the roller in the fixed position, if the roller is moved in the axial direction by the reaction force of a sheet, the lateral movement control mechanism returns the roller to its original position. The spring retainer 32 is hollow and cylindrical, and a stopper 34 is held within the spring retainer 32. The stopper 34, which can be in the form of an E-ring or the like, is fixed to the drive axis 21 and is used to restrict the distance moved by the spring retainer 32 and the roller 22.

FIG. 5 shows the structure of the other end of the drive roller member 20, which is symmetrical to the structure shown in FIG. 4. In it, a spring 31*a* is disposed between a bearing 26*a* installed in the main frame 9*a* and a spring retainer 32*a*, and a stopper 34*a* provided around the axis 21 is held within a hollow and cylindrical spring retainer 32*a*, which restricts the distance moved by the spring retainer 32*a* and the roller 22.

As shown in FIGS. 4 and 5, in the drive roller member of the present invention, linear bearing members 25 and 25a are interposed between the drive axis 21 and the roller 22, allowing the roller 22 to move in the axial direction. By providing the stoppers 34 and 34a at both ends of the roller 22, the distance moved by the roller can be specified in the range shown as L in the figure, when the roller is moved in the axial direction. As shown in FIG. 6, when the roller member is moved to the left, the spring 31a in the lateral movement control mechanism 30a, which expands, does not expand excessively, because the stopper 34a prevent the spring retainer 32a from moving. On the other hand, the spring 31 in the lateral movement control mechanism 30, which is compressed by the roller member, contracts by the small length shown as L.

Figure 7:
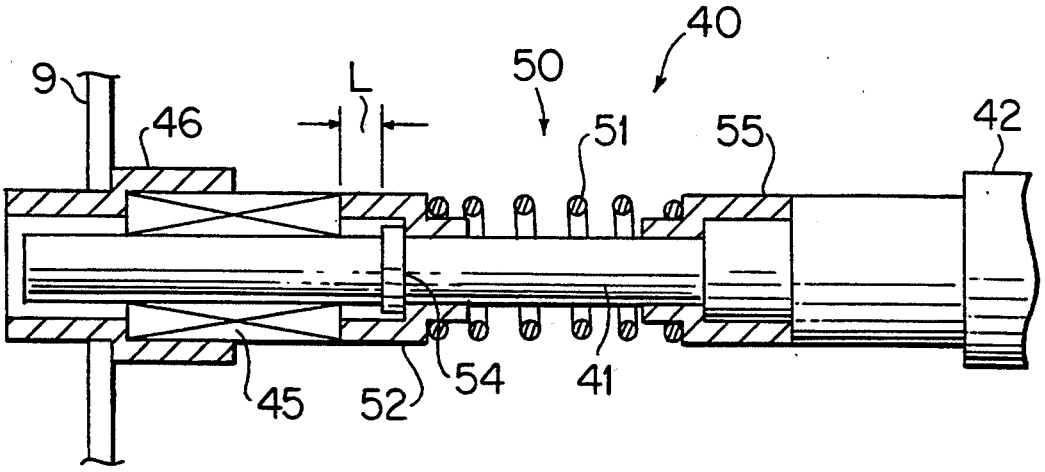
FIG. 7 illustrates the structure of an end of a free roller member of the present invention.
Figure 8:
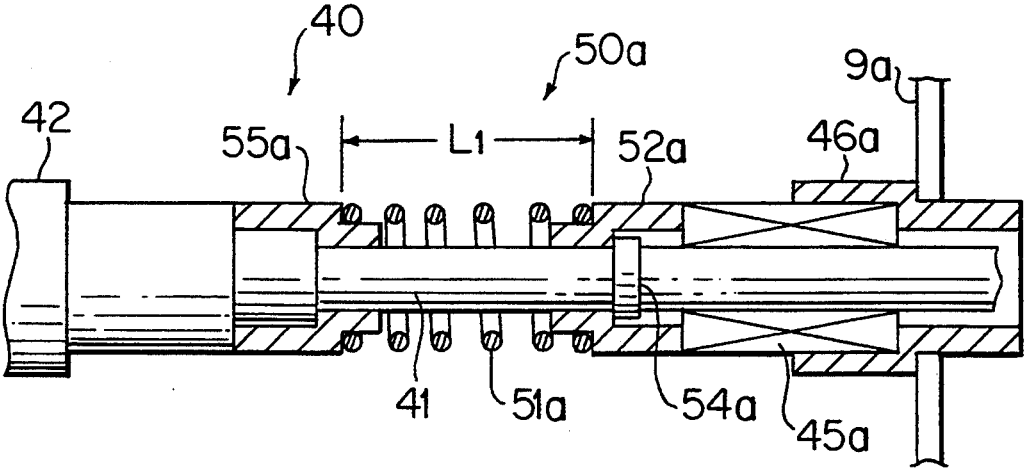
FIG. 8 illustrates the structure of the other end of a free roller member of the present invention.

The free roller member 40 disposed facing the drive roller member 20, as shown in FIGS. 7 and 8, comprises the roller 42 fixed to the drive axis 41 which is supported by the frame 9 and 9a provided at both ends of the member by means of linear bearing members 45 and 45a. Each portion shown in FIG. 7 is symmetrical to that in FIG. 8, so the free roller member 40 of the present invention is now described referring to FIG. 7. As shown in FIG. 7, the linear bearing member 45 is supported by the bearing support member 46 which is connected to the main frame 9, and the lateral movement control mechanism 50 is disposed between the linear bearing member 45 and the roller 42. The lateral movement control mechanism 50 comprises a spring retainer 52 disposed next to the linear bearing member 45, a bracket member 55 disposed at an end of the roller 42 and a spring 51 supported therebetween.

In the lateral movement control mechanism 50, a hollow and cylindrical spring retainer 52 is disposed next to the linear bearing member 45, and a stopper 54 is provided by fixing an E-ring or the like to the drive axis 41. The stopper 54 controls the distance moved by the drive axis 41, specifying it to be the small length shown as L, and it also controls the expansion of the spring provided in the lateral movement control mechanism. The spring retainer provided at an end of the roller is made of a material whose friction coefficient toward the drive axis and the roller is small, and here, a plastic material is used. Each portion of the other end of the free roller member shown in FIG. 8 is symmetrical to that shown in FIG. 7 and it is indicated by a symbol which is made by adding (a) to the corresponding symbol in FIG. 7.

Figure 9:
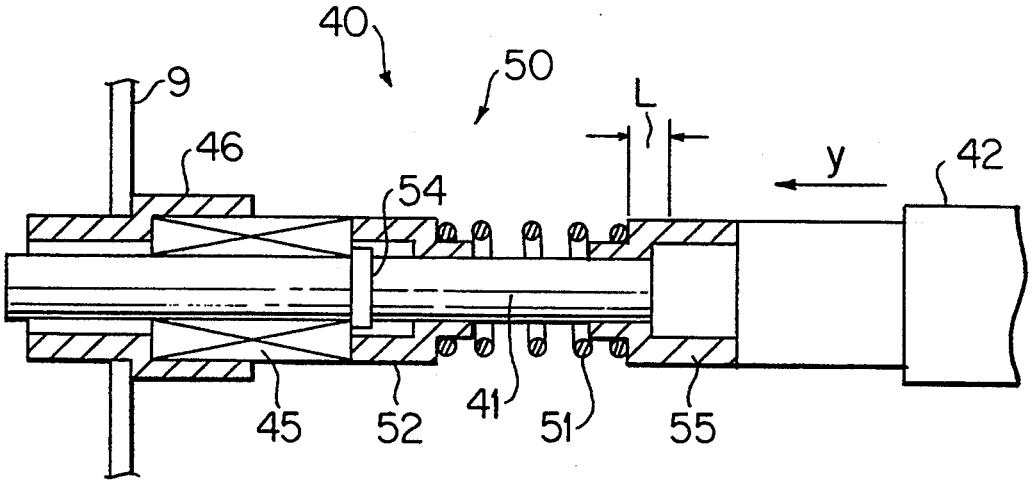
FIG. 9 illustrates the state of a free roller member corresponding to FIG. 7 being moved.

If a force moving the roller in the axial direction is applied to the above structured free roller member 40 from a sheet, a compression action is applied to one side of the lateral movement control mechanism, and on the other hand, an expanding force is applied to the other end of the member. For example, if a force toward the left side of FIG. 9 is applied to the roller 42, the drive axis 41 of the roller member 42 slides with respect to the linear bearing member 45, and a force compressing the spring 51 is applied to the lateral movement control mechanism 50. The distance moved by the drive axis 41 is specified to be the range shown as L in FIG. 7, up to which the stopper 54 is movable. Therefore, even if the distance moved by the roller is maximum, the compression force on the spring of the lateral movement control mechanism is limited by moving it in the direction of the arrow y within the range L shown in FIG. 7.

Figure 10:
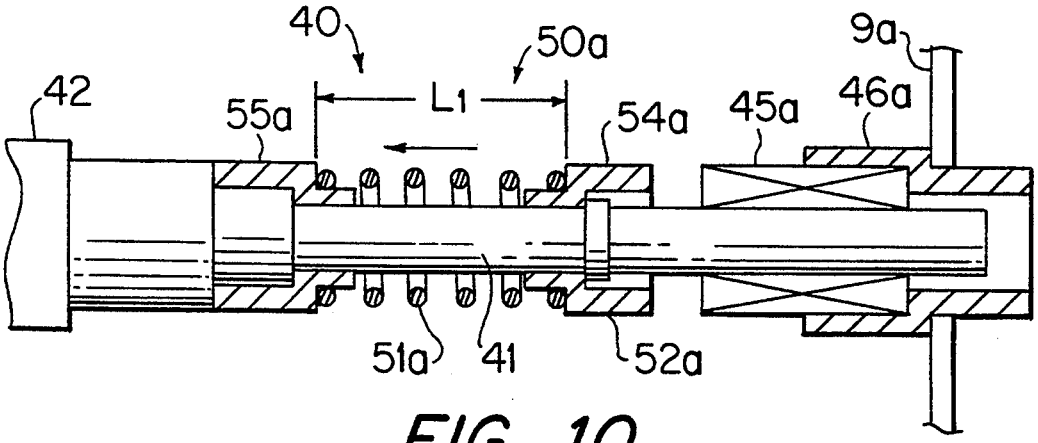
FIG. 10 illustrates the state of a free roller member corresponding to FIG. 8 being moved.

If the drive axis 41 is moved in the state shown in FIG. 9, at the other end of the roller, as shown in FIG. 10, the lateral movement control mechanism 50a is moved in the direction of the arrow y. In the lateral movement control mechanism 50a, however, as the stopper 54a provided around the drive axis 41 moves the spring retainer 52a in the axial direction, the lateral movement control mechanism 50a is moved with the drive axis 41 without applying excessive expanding action to the spring 51a, which results in a gap between the spring retainer 52a and the linear bearing members 45a.

Therefore, in the roller device of the present invention, the length L1 of the spring when being moved as shown in FIG. 10 is not different from that in the normal state as shown in FIG. 8, and excessive expanding action is not applied to the spring. As shown in FIG. 9, only the spring 51, which is compressed, is subject to compression action, by the length L. Only compression forces are applied to the spring disposed in the lateral movement control mechanism, and by specifying the amount of pressure to be very small, change of the spring characteristics is prevented, which leads to a good return quality.

ANOTHER EMBODIMENT OF THE ROLLER DEVICE

Figure 11:
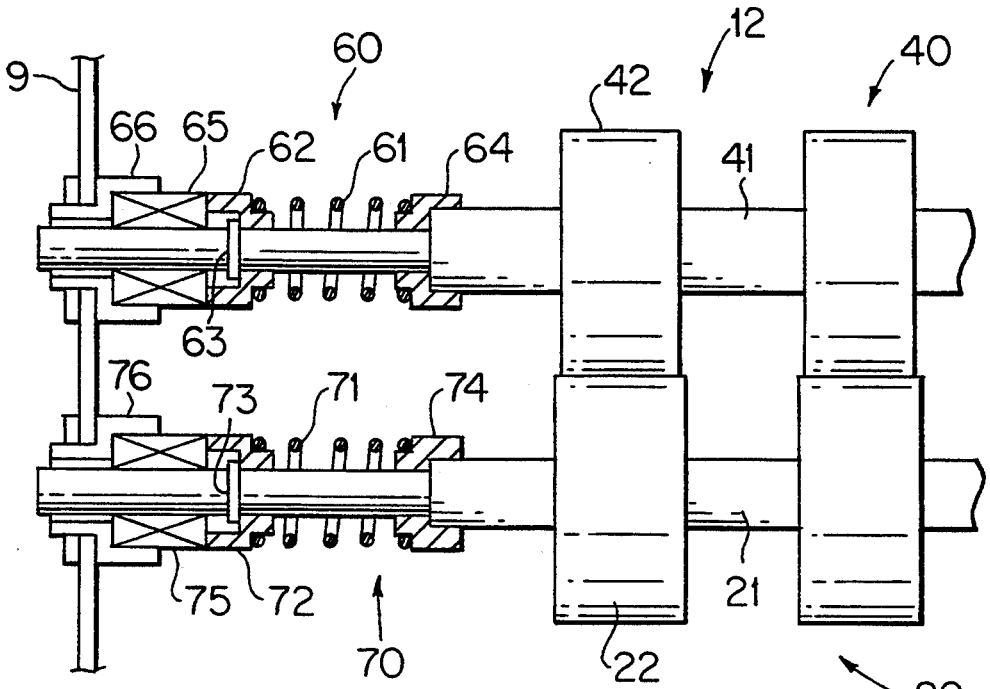
FIG. 11 illustrates the other structure of the roller members of the present invention.

In the example of the preregistration roller device of the present invention described so far, the structure of the drive roller member and that of the free roller member are different, but in the roller device of the present invention, as shown in FIG. 11, the same structure may also be used for the drive and free roller members. In the preregistration roller device 12 shown in FIG. 11, the drive roller member 20 comprises a drive axis 21 with a plurality of rollers 22 installed thereon spaced linearly apart, and the free roller member 40 comprises a drive axis 41 with a plurality of roller 42 installed thereon spaced linearly apart. In the preregistration roller device, each roller member comprises a linear bearing member 65 or 75 disposed within a bearing support member 66 or 76 connected to the main frame 9, and the axis 21 or 41 is movable in the axial direction by means of linear bearing members.

Each of the lateral movement control mechanism 60 or 70 comprises a bracket member 64 or 74 disposed around the staged portion of the drive axis 21, a spring retainer 62 or 72 disposed interiorly next to the linear bearing member and a spring 61 or 71 disposed between both members. The structure of the lateral movement control mechanism is now described in more detail, referring to FIG. 12. The stopper 63 is fixed to the drive axis 41, and it is disposed corresponding to a hollow spring retainer 62. As in each of the above described embodiments, the stopper 63 controls the range of movement of the axis, and it does not allow the spring 61 provided in the lateral movement control mechanism 60 to expand excessively.

Figure 12:
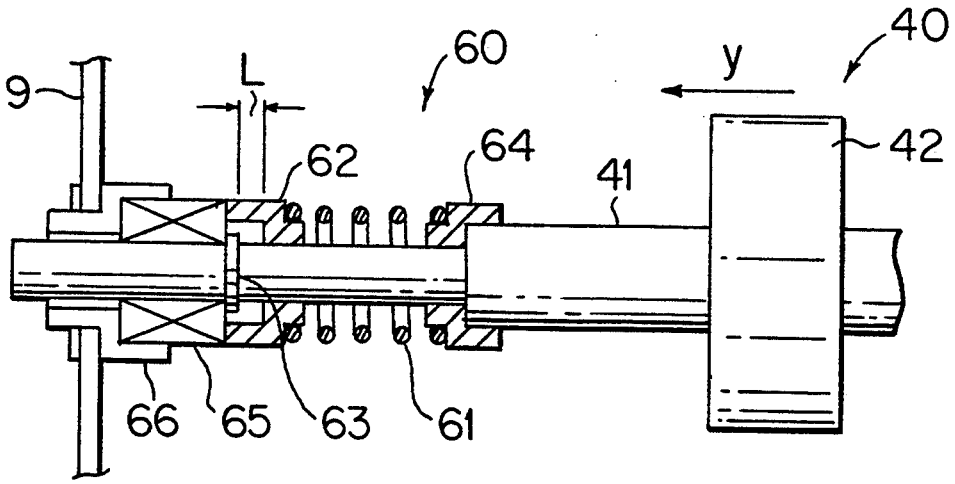
FIG. 12 illustrates the state of a lateral movement control mechanism with the roller member moved in one direction.
Figure 13:
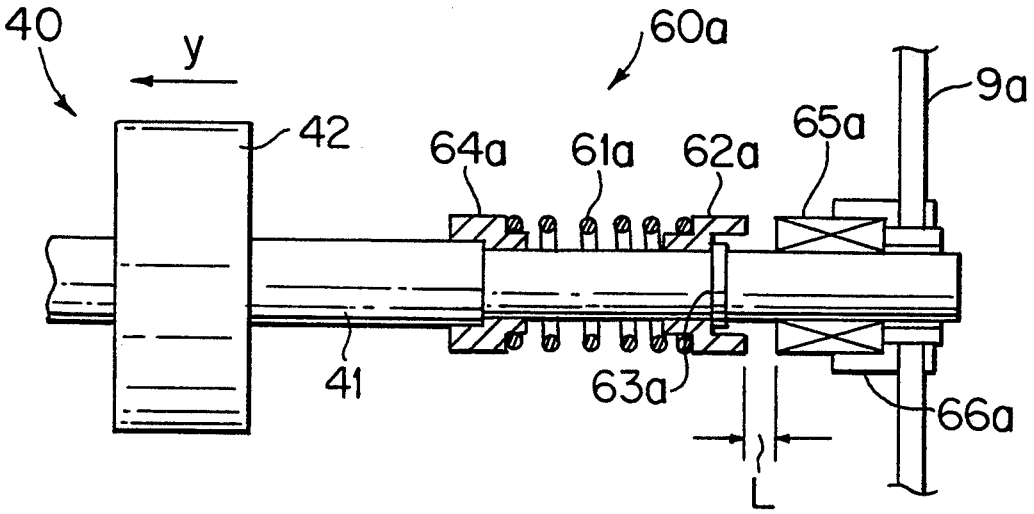
FIG. 13 illustrates the state of a lateral movement control mechanism in the opposite side of FIG. 12.

At the other end of the roller shown in FIG. 12, as shown in FIG. 13, are disposed a spring retainer 62a, a bracket member 64a and a spring 61a, which form the lateral movement control mechanism 60a. As the drive axis 41 is moved in the direction of the arrow y, the stopper moves the lateral movement control mechanism 60a toward the left side of the figure to prevent the spring 61 from expanding excessively. Therefore, even if the drive and free roller members are supported by the lateral movement control mechanisms of the same structure, rollers can be moved in the direction eliminating the lateral reaction force of the sheet, and provide a device which applies a compression force to the spring, by the small length, in relation to the movement of the rollers.

IN THE CASE WHEN A DEVICE SUPPLYING A SHEET TO THE TRANSFER DRUM IS DISPOSED

Figure 14:
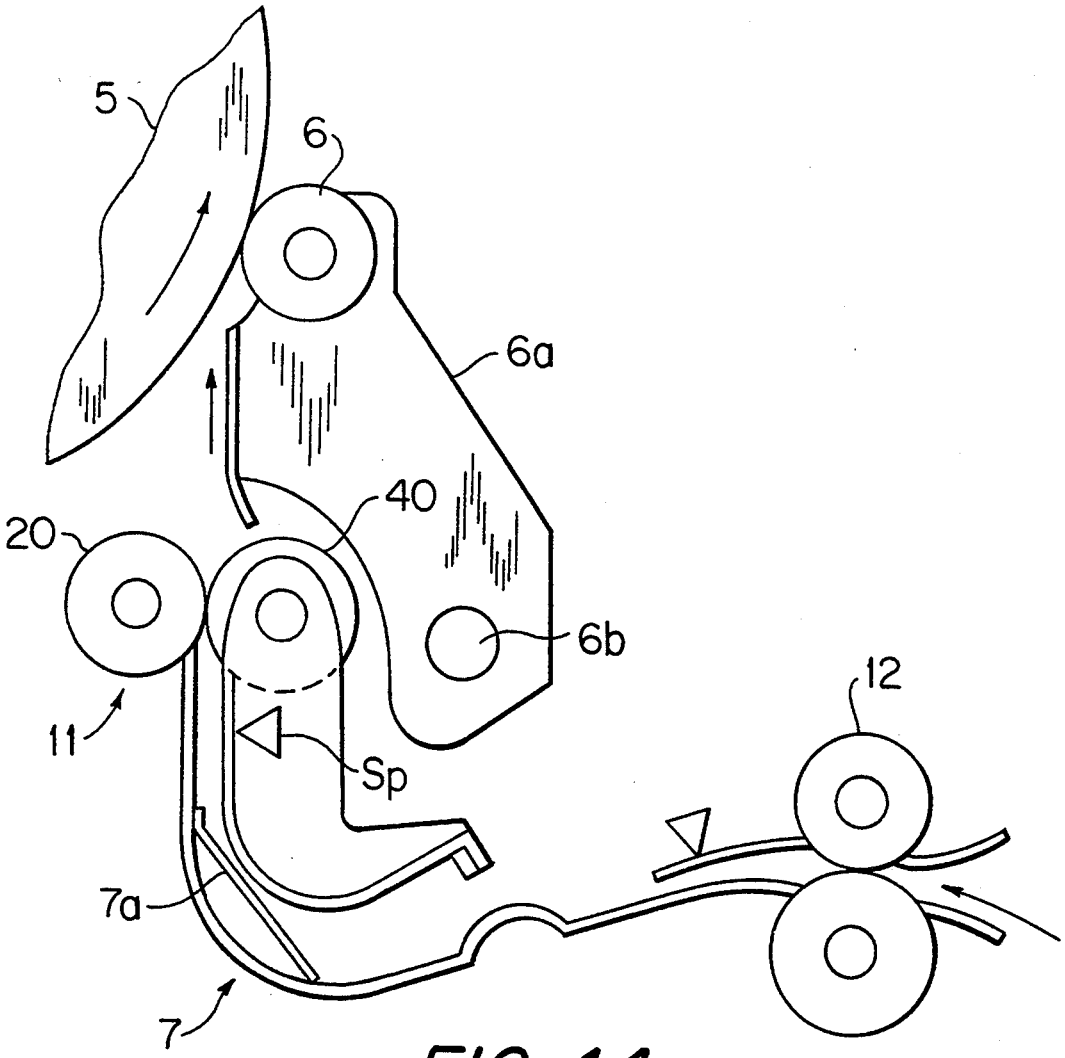
FIG. 14 is a side view of an example in which the roller devices of the present invention are applied to the portion where a sheet is supplied to a transfer drum.

Embodiment of the roller device of the present invention has been described so far in the case when it is applied to a device in which the preregistration roller device of the sheet registration system is moved in the axial direction by a reaction force of a sheet, and the rollers shown in FIG. 2 of the present invention can be applied to the registration roller device shown in FIG. 14. In the example shown in FIG. 14, a color copying machine in which a photoreceptive drum is disposed corresponding to a transfer drum 5 holding a sheet is shown, and color toner images formed on the photoreceptive drum are transferred successively to the sheet. The sheet registration system supplying the sheet to the transfer drum 5 comprises a curved sheet transport path 7 between the registration roller device 11 and the preregistration roller device 12.

A sheet is curved downward between the registration and preregistration roller devices, and after being stopped temporarily to have its leading edge registered, it is supplied to the transfer drum 5 by driving the registration roller device 11, and then, it is pressed against the drum by a pressure roller 6, and it adheres to the drum and is held by it. The pressure roller 6 is supported by an arm member 6*a* which is supported by a support axis 6*b*, and only while pressing the sheet against the transfer drum, roller 6 is pressed against the transfer drum 5 by rocking the arm member 6*a* by a drive system which is not shown in the figure.

A film 7*a* in the curved transport path 7 is pressed from the outside of the curved portion, and in feeding out a sheet, it urges the sheet toward the registration roller device using a reaction force of the film. In the sheet registration system upstream of the transfer drum, the registration roller device 11 has the structure as shown in FIGS. 2 or 11.

Figure 15:
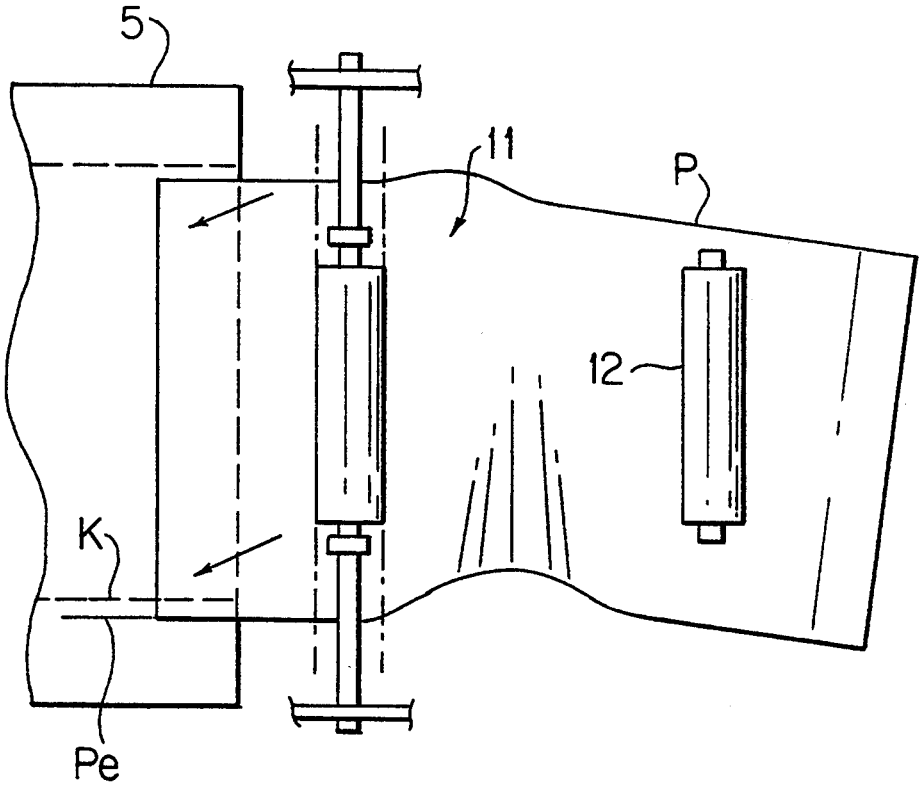
FIG. 15 illustrates the relation between a sheet and the registration roller device in the sheet registration system shown in FIG. 14.

In a sheet feeding system having the above described structure, a sheet is fed from the preregistration roller device 12, and the sheet is curved as the leading edge is held by the registration roller device 11. Next, when the registration roller device 11 is driven, as shown in FIG. 15, as the sheet P is fed out skewed by the reaction force of the curve of the sheet with its side Pe offset from the reference line K of the transfer drum 5, in the present invention, by making the rollers of the registration roller device 11 movable along its axis, the registration roller device 11 can be moved in the direction along the drive axis by a lateral reaction force of the sheet.

Figure 21:
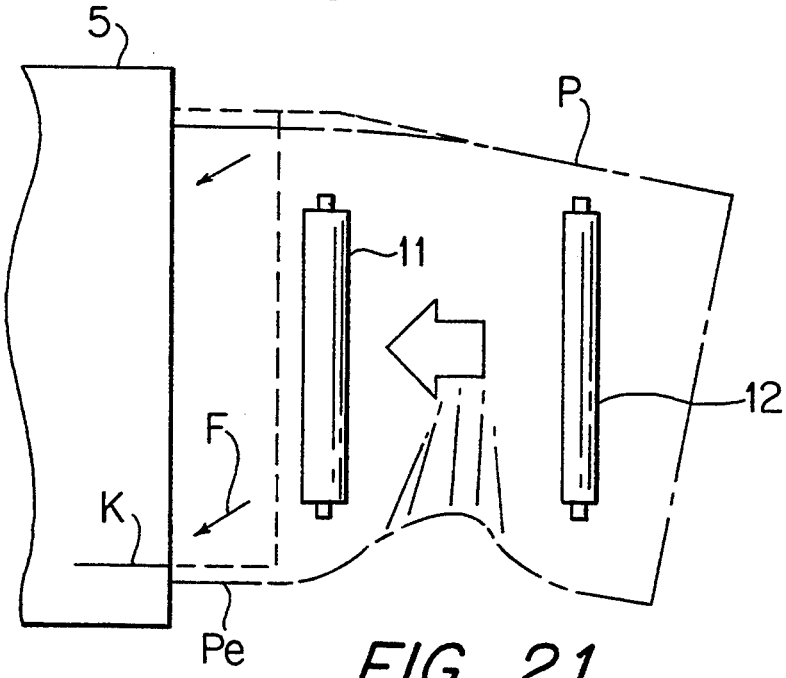
FIG. 21 illustrates the state of a sheet being dislocated while it is held by a transfer drum.
Figure 16:
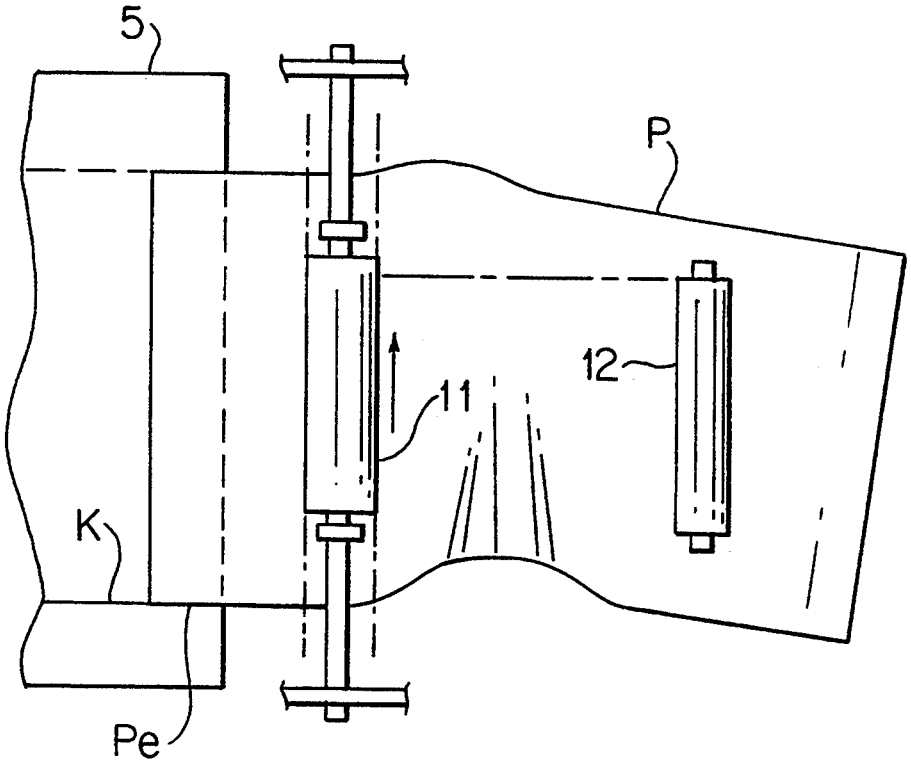
FIG. 16 illustrates the state of a sheet being held by the transfer drum.

With this improvement, as shown in FIG. 16, when a sheet is fed out with the side Pe of the sheet brought in registration with the reference line K of the transfer drum 5, excessive stress is not applied to the film for retaining the sheet by a lateral reaction force of the sheet. Therefore, as the reaction force from the film is not applied to the sheet held by the transfer drum, even if the sheet is passed through the registration roller device, a toner image is transferred completely free of dislocation as shown in FIG. 21.

ANOTHER EMBODIMENT IN WHICH A DEVICE MOVING THE ROLLERS IS PROVIDED IN THE REGISTRATION ROLLER DEVICE

Figure 17:
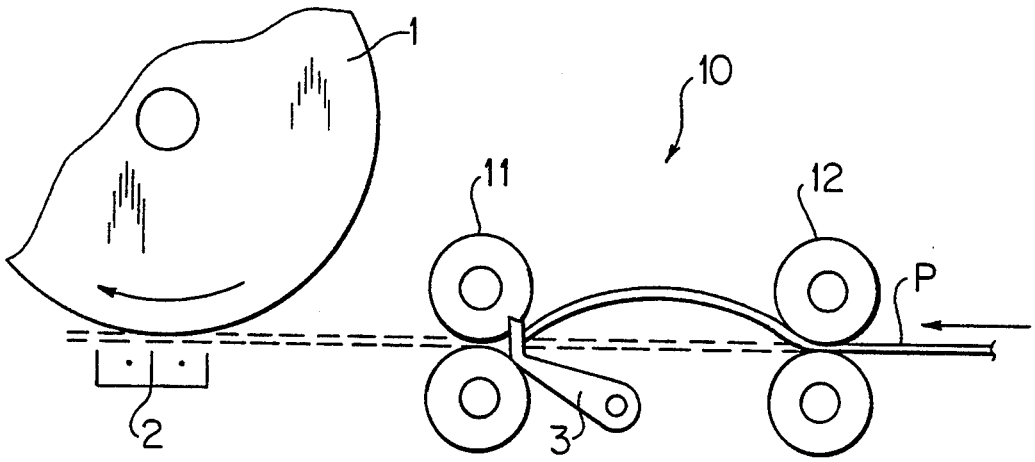
FIG. 17 is a side view of an example in which the roller device of the present invention is applied to the registration roller device.

In addition to being applied to the preregistration roller device, as shown in FIG. 17, the rollers of the present invention can be incorporated in the registration roller device 11 in the sheet registration system 10 upstream of the photoreceptor drum 1. In the sheet registration system 10 shown in FIG. 17, are provided gate members 3 corresponding to the registration roller device 11, a preregistration roller device 12 upstream of them with a specified spacing from them. A sheet is curved between these devices, and the registration of the leading edge of the sheet is carried out.

Figure 18:
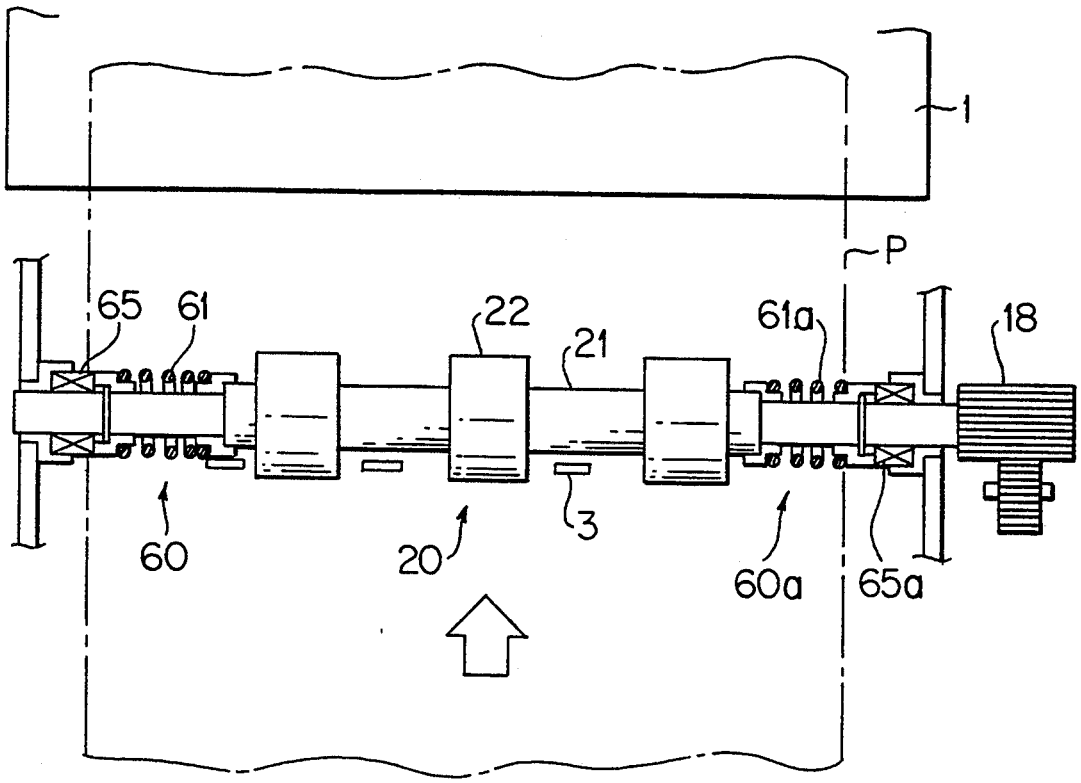
FIG. 18 illustrates the relation between the roller device used in FIG. 17 and a photoreceptive drum.

In the registration roller device 11, as shown in FIG. 18, lateral movement control mechanisms 60 and 60*a* are disposed at both ends of the rollers. Here the rollers have the same structure as shown in FIG. 11, but may have the same structure as shown in FIG. 2. In the drive roller member 20 of the registration roller device 11, a drive system is disposed at one end of the drive axis 21, and it operates the rotation of the rollers to correspond to the feeding out of a sheet. As shown in FIG. 18, lateral movement control mechanisms 60 and 60*a* are disposed at both ends of the drive roller member 20, and they control the movement in the axial direction of the rollers and prevent excessive expansion of the springs therein, which prevents the deterioration of the springs.

By providing the above described controlling means, in the sheet registration system 10 shown in FIG. 17, the leading edge of a sheet is arranged by the gate members 3 and it is registered by the curve of the sheet. When the gate members 3 are released causing the sheet to be held by the registration roller device 11, a reaction force in the lateral direction from the sheet acts directly on the registration roller device and moves the rollers of the registration roller device in the axial direction, which releases the reaction force of the sheet. The feeding process of a sheet supplied to the photoreceptive drum 1 through the registration roller device 11 is kept on, arranging the side of the sheet, with the registration roller device moved, until the sheet passes through the registration roller device.

After the trailing edge of the sheet passes through the registration roller device 11, a reaction force of the sheet toward the registration roller device is released, and the rollers return to their original position by the reaction force of the lateral movement control mechanism in the compressed side, so that it is ready for the next sheet feeding. At both ends of the rollers shown in the embodiment are disposed lateral movement control mechanisms which only receive a compressing action, so even if one of the springs is compressed by the reaction force of a sheet, the other spring is not allowed to expand. After the reaction force caused by a sheet is released, the rollers return to their original position by the reaction force of the compressed spring, and rollers are held stationary in the position where the force of each lateral movement control mechanism is equal.

In addition to the position immediately before the image transfer section, in an image-forming device, the combination of the drive and free roller members of the present invention can be also applied to anywhere in the sheet transport path. The rollers of the present invention can also be incorporated in the document transport path of the image-forming device, and it is possible to apply the rollers shown in FIG. 2 or 11 to a device correcting skewing of the document. If the rollers are incorporated in the document transport path, documents are transported safely, being free of the stress in the lateral direction.

What is claimed is:

1. A sheet transport roller device having a drive roller member and a free roller member facing each other with a specified pressure between them to transport a sheet held between them, a device that allows each roller of the drive and free roller members to move in the axial direction, urging members disposed at both ends of the rollers, in which the roller members are moved in the direction lateral to a sheet transport path as a sheet is held by the roller members, in accordance with an action moving said sheet in the direction lateral to the transport path.

2. The sheet transport roller device described in claim 1, further comprising lateral movement control mechanisms containing the urging members, the mechanisms disposed at both ends of the rollers of the drive and free roller members, the mechanisms which restricts the expansion and allows the contraction of the urging members and in which the rollers of the drive and free roller members return to their original position automatically after a force moving the rollers is released.

3. The sheet transport roller device described in claim 2, wherein the drive and free roller members are fixed to a drive axis which is movable in the axial direction by means of linear bearing members installed in a main frame.

4. The sheet transport roller device described in claim 2, wherein the drive and free roller members are fixed to the drive axis movably in the axial direction with linear bearing members interposed therebetween, the urging members comprising spring retainers disposed at both ends of the rollers, and spring members disposed therein, and the lateral movement control mechanisms are disposed between the spring retainers and bearing members installed in the main frame.

5. A sheet transport roller device having a sheet registration system comprising a registration roller device, a preregistration roller device and gate members adapted to be disposed in a sheet transport path, in which a registration roller device is moved in the lateral direction of the path as the leading edge of a sheet is held by the registration roller device and a sheet is fed out aligned with a reference line, wherein the preregistration roller device comprising a sheet transport roller device having a drive roller member and a free roller member disposed facing each other with a specified pressure between them and transport a sheet held between them, a device which allows each roller of the drive and free roller members to move in the axial direction, urging members disposed at both ends of the rollers, in which a sheet is moved in the lateral direction of the sheet transport path as the sheet is held by the roller members by a lateral stress applied to the sheet caused by an action of the registration roller device to move a sheet in the lateral direction of the sheet transport path, and after a sheet is fed out, moving the rollers to their original position automatically.

6. A sheet transport roller device comprising a registration system comprising a registration roller device, preregistration roller device and gate members adapted to be disposed in a portion where a sheet is supplied to a transfer drum of an apparatus which transfers successive color toner images and is disposed corresponding to a transfer drum holding a sheet, wherein the preregistration roller device comprising a sheet transport roller device having a drive roller member and a free roller member disposed facing each other with a specified pressure between them and transport a sheet held between them, a device which allows each roller of the drive and free roller members to move in the axial direction, urging members disposed at both ends of the rollers, in which the roller members are moved in the lateral direction of a sheet transport path while holding a sheet to eliminate a shear reaction force from shear strain occurring in a sheet, and after feeding out a sheet by the registration roller device, moving the rollers to their original position automatically.

7. A sheet transport roller device having a sheet registration system comprising a laterally movable registration roller device and a laterally movable preregistration roller device adapted for feeding out a sheet toward an image transfer section, in which when the registration roller device is moved in the lateral direction of a sheet transport path and as the sheet is held by the roller devices by a shear reaction force in the sheet, the preregistration roller device is moved laterally in response to the sheer force and thus the shear reaction force is eliminated, and after feeding out a sheet by the registration roller device, lateral movement control mechanisms engaging the preregistration roller device returns the preregistration roller device to its original position.

* * * * *